US005293143A

United States Patent [19]

Sakakino et al.

[11] Patent Number: 5,293,143

[45] Date of Patent: Mar. 8, 1994

[54] SWITCH DEVICE

[75] Inventors: Takahiro Sakakino, Kyoto; Seiki Satoh, Chiba, both of Japan

[73] Assignee: Omron Corporation, Kyoto, Japan

[21] Appl. No.: 904,052

[22] Filed: Jun. 26, 1992

[30] Foreign Application Priority Data

Jun. 28, 1991 [JP] Japan ..... 3-49870
Jun. 28, 1991 [JP] Japan ..... 3-49871
Jun. 28, 1991 [JP] Japan ..... 3-50047

[51] Int. Cl.[5] ..... H01H 3/00; H01H 23/00; H01H 45/00

[52] U.S. Cl. ..... 335/186; 335/164

[58] Field of Search ..... 200/61.27, 61.54, 12; 335/185, 186, 129, 164–166, 187–204

[56] References Cited

U.S. PATENT DOCUMENTS 4,429,196 1/1984 Beig et al. ..... 200/61.54
4,902,860 2/1990 Maeda ..... 200/61.27
5,075,519 12/1991 Hayakawa ..... 200/61.54

*Primary Examiner*—J. R. Scott
*Attorney, Agent, or Firm*—Foley & Lardner

[57] ABSTRACT

In a switch device, slide plates slide on a microswitch casing independently from each other. When one of the slide plates is slid in a left-hand side direction from its neutral position against a biasing force of a spring, a cam portion thereof depresses an actuator by a predetermined constant amount putting a corresponding microswitch mechanism into an ON state. Similarly, when the other slide plate is slid in a right-hand side direction from its neutral position against a biasing force of the spring, a cam portion thereof depresses another actuator by a predetermined constant amount to put a second microswitch mechanism into an ON state. Each slide plate is operatively, selectively held through a solenoid device at that position where its cam portion depresses the corresponding actuator.

10 Claims, 12 Drawing Sheets

SWITCH DEVICE

BACKGROUND OF THE INVENTION

The present invention relates to a switch device, and more particularly, to a switch device having both a self-returning position and a self-holding position in each switch mechanism.

It is known to use a switch device having a self-returning position which is called a "manual operation position" and a self-holding position which is called on "automatic operation position" for a power window, a sun-roof, or the like in an automotive vehicle.

Such a switch device generally has three shift positions, i.e. a neutral position putting a mechanism into an OFF-state, a moving-up position putting the mechanism into a state where a glass of the power window, for example, is moved upward, and a moving-down position putting the mechanism into a state where the window glass is moved downward. Further, in each of the moving-up and moving-down positions there are two operation mode positions, i.e. a self-return position and a self-holding position. When a manipulator such as a knob is operated by hand to move from the neutral position into the self-returning position, the mechanism is shifted into the moving-up state or the moving-down state. However, when the manipulator is released to be returned to the neutral position, the mechanism is automatically shifted and returned to the OFF-state. On the contrary, once the manipulator is moved from the neutral position into the self-holding position across the self-returning position, a shifted electrical connection is held by a solenoid device to continue to hold the moving-up state or the moving-down state even when the manipulator is returned to the neutral position. The switch of this type is disclosed in the Japanese Utility Model Unexamined Publication Nos. 64-226 and 64-239.

In such a conventional switch device, the manipulator, such as a knob rotatably returnably mounted on a switch housing, is coupled and associated through an interconnecting member with a leaf-spring having a contact portion. The leaf-spring is depressed through the interconnecting member in accordance with an amount of rotation of the manipulator. The contact portion is thereby shifted into a desired state. Therefore, in order to appropriately set the self-returning position and the self-holding position in connection with the contact portion shifting stroke, each of component parts is required to have a high degree of dimensional precision, and the component parts are assembled with each other in high accuracy. Further, a high balancing between a biasing force of the leaf spring and a force of the solenoid device, which is to retain the shifted contact portion in place, is required in order to perform the self-holding operation.

In addition to the above-noted requirement, such a conventional switch device has an increased number of components, a complicated arrangement of components, and suffers from problems in producibility, stability of performance, reliability of operation, durability, or the like.

SUMMARY OF THE INVENTION

The present invention was made in order to solve the above-noted and other problems.

It is an object of the present invention to provide a switch device which is simple in construction, and in which each of component parts is not required to have the high-dimensional precision, and the component parts are assembled with each other without extremely high accuracy and high balancing.

It is another object of the present invention to provide a switch device which is improved in producibility, stability of performance, reliability of operation, durability, or the like.

In order to attain the above-noted and other objects, in an embodiment of the present invention, a switch device includes a switch casing accommodating switch mechanisms having respective first and second actuators juxtaposed with each other. Each of the actuators is projected from an outer surface of the casing and adapted to be depressed to shift a contact portion of corresponding switch mechanism independently from the other. A first slide plate is slidably provided on the outer surface of the switch casing and has a cam portion which depresses the first actuator by a predetermined constant amount when the first slide plate is moved in a first direction from its neutral position. The first slide plate is prevented from being slid from its neutral position in a second direction opposite to the first direction. A second slide plate is slidably provided on the outer surface of the switch casing and has a cam portion which depresses the second actuator by the predetermined constant amount when the second slide plate is slid in the second direction from its neutral position. The second slide plate is prevented from being moved from its neutral position in the first direction. A spring urges the first slide plate in the second direction and the second slide plate in the first direction. A knob has an engagement portion which is engaged between a first engagement projection formed on the first slide plate and a second engagement projection formed on the second slide plate and reciprocally movable in the first and second directions. A switch shifted position holding solenoid means including a movable member movable in the first and second directions and engaged between the first engagement projection of the first slide plate and the first engagement projection of the second slide plate so that movements in the first and second directions of the movable member are restricted thereby. An electro-magnetic attraction device applies a first attraction force to the movable member to move the movable member in the first direction by depressing the first actuator and applies a second attraction force to the movable member to move the movable member in the second direction by depressing the second actuator, so that when the movable member is moved more than a predetermined amount in the first or second direction, the movable member is held at that position.

In another embodiment of the present invention, a switch device includes a switch casing accommodating switch mechanisms having respective first and second actuators juxtaposed with each other. Each of the actuators is projected from an outer surface of the casing and adapted to be depressed to shift a contact portion of corresponding switch mechanism independently from the other. A first slide plate is slidably provided on the outer surface of the switch casing and has a cam portion which depresses the first actuator by a predetermined constant amount when the first slide plate is moved in a first direction from its neutral position. The first slide plate is prevented from sliding from its neutral position in a second direction opposite to the first direction. A second slide plate is slidably provided on the outer surface of the switch casing and has a cam portion which depresses the second actuator by the predetermined constant amount when the second slide plate is slid in the second direction from its neutral position. The second slide plate is prevented from being moved from its neutral position in the first direction. A knob has an engagement portion which is engaged between a first engagement projection formed on the first slide plate and a second engagement projection formed on the second slide plate and is reciprocally movable in the first and second directions. A lock plate is movable in the first and second directions from its neutral position, adapted to be engaged with the first slide plate to be moved in the first direction from its neutral position together with the first slide plate when the first slide plate is moved in the first direction more than a first predetermined amount, and adapted to be engaged with the second slide plate to be moved in the second direction from its neutral position together with the second slide plate when the second slide plate is moved in the second direction more than a second predetermined amount. A spring biases the first slide plate in the second direction and the second slide plate in the first direction. A switch shifted position holding solenoid includes a movable member movable in directions perpendicular to the first and second directions, and positioned at a forward position in a non-excitation state and at a backward position in an excitation state, so that when the lock plate is moved in the first or second direction from its neutral position, the movable member at the forward position is engaged with the lock plate to thereby retain the lock plate in that position.

In another embodiment of the present invention a switch device includes a switch casing accommodates switch mechanisms having respective first and second actuators juxtaposed with each other, each of the actuators projected from an outer surface of the casing and adapted to be depressed to shift a contact portion of corresponding switch mechanism independently from the other. A slide plate is slidably provided on the outer surface of the switch casing, and has a first cam portion which depresses the first actuator by a predetermined constant amount when the slide plate is moved in a first direction from its neutral position and a second cam portion which depresses the second actuator by the predetermined constant amount when the slide plate is slid in the second direction from its neutral position. A knob is engaged with the slide plate to drive the slide plate in the first and second directions. A lock plate, movable in the first and second directions from its neutral position, is adapted to be engaged with the slide plate to be moved in the first direction from its neutral position together with the slide plate when the slide plate is moved in the first direction more than a first predetermined amount, and is adapted to be engaged with the slide plate to be moved in the second direction from its neutral position together with the slide plate when the slide plate is moved in the second direction more than a second predetermined amount. The lock member has a third cam portion which depresses the first actuator by the predetermined constant amount when the lock plate is moved in the first direction from its neutral position and a fourth cam portion which depresses the second actuator by the predetermined constant amount when the lock plate is moved in the second direction from its neutral position. A spring biases the lock plate toward its neutral position. A switch shifted position holding solenoid means including a movable member movable in directions perpendicular to the first and second directions, and positioned at a forward position in a non-excitation state and at a backward position in an excitation state, so that when the lock plate is moved in the first or second direction from its neutral position, the movable member at the forward position is engaged with the lock plate to thereby retain the lock plate in that position.

In the present invention, a microswitch is preferably used for the switch mechanism.

DETAILED DESCRIPTION OF THE PREFERRED EMBODIMENTS

Preferred embodiments of the present invention will now be described in detail with reference to the accompanying drawings attached hereto.

Figure 1:
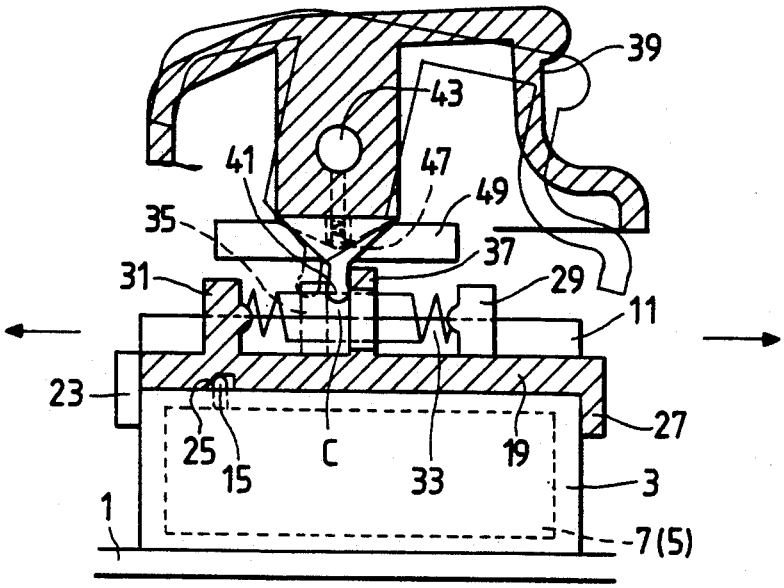
FIG. 1 is a side view showing a switch device according to a first embodiment of the present invention, in which the present invention is applied to a switch device for a power window in an automotive vehicle.
Figure 2:
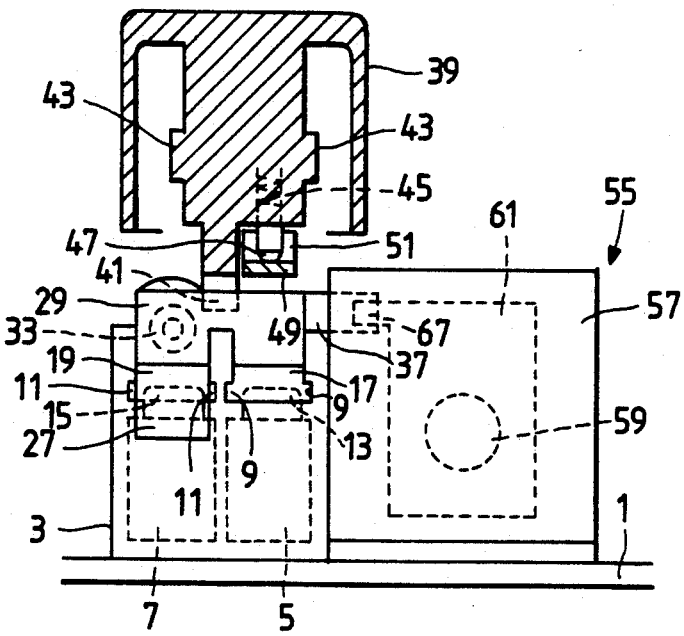
FIG. 2 is a front view as viewed from left-hand side in FIG. 1.

FIGS. 1 to 7 show a switch device according to a first embodiment of the present invention, which is used, for example, as a switch device for a power window in an automotive vehicle. The switch device includes a microswitch casing 3 fixedly mounted on a printed circuit board 1. As shown in FIGS. 1 and 2, two microswitches 5 and 7 each having well-known construction are juxtaposed with each other and sealed within the casing 3.

Figure 3:
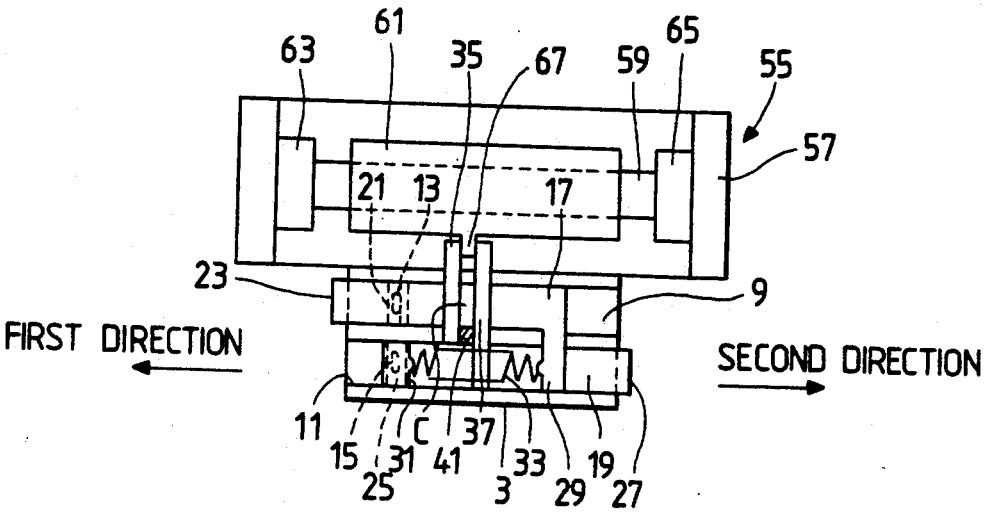
FIG. 3 is a view showing the switch device in which first and second slide plates are in their neutral position.

The microswitch casing 3 is formed with grooves 9, which face each other above the microswitch 5 as best shown in FIG. 2 and extended transversely in FIG. 3, so that a head portion of an actuator 13 of the microswitch 5 projects between the grooves 9. Similarly, grooves 11 are formed in the microswitch casing 3 so that a head portion of an actuator 15 of the microswitch 7 projects between the grooves 11. Each of the actuators 13 and 15 is a type generally called a push-button type or push-plunger type, which functions by depressing it by a predetermined constant amount to shift a contact portion of a microswitch mechanism from an ON state into an OFF state, or vice versa.

Slide plates 17 and 19, which are slidingly movable in a transverse direction, are fitted into the grooves 9 and 11 respectively, as shown in FIG. 3.

The slide plate 17 (hereinafter referred to as a first slide plate when applicable) has a planar cam portion 21 at a bottom thereof, the cam portion 21 being formed with a recess having a substantially trapezoid sectional-shape. Accordingly, when the slide plate 17 is moved from a neutral position shown in FIG. 3 toward a left-hand side in FIG. 3 (the direction toward a left-hand side in FIG. 3 is hereinafter referred to merely as a first direction), the actuator 13 is depressed downward by a predetermined constant amount through the planar cam portion 21.

As best shown in FIGS. 1 and 3, a stopper piece 23 is integrally formed on a left end of the slider plate 17, and is capable of abutting a left end surface of the microswitch casing 3 so that the slide plate 17 positioned at the neutral position as shown in FIG. 3 is prevented from moving in a second direction opposite to the first direction.

Similarly, the slide plate 19 (hereinafter referred to as a second slide plate) has a planar cam portion 25 at a bottom thereof, the cam portion 25 being formed with a recess having a substantially trapezoid sectional-shape. Accordingly, when the slide plate 19 positioned at the neutral position shown in FIG. 3 is moved in the second direction, the actuator 15 is depressed downward by a predetermined constant amount through the planar cam portion 25. A stopper piece 27 is integrally formed on a right-hand end of the slide plate 19 and is capable of abutting against a right end surface of the microswitch casing 3 so that the slide plate 19 positioned at the neutral position as shown in FIG. 3 is prevented from moving in the first direction.

The first and second slide plates 17 and 19 are respectively formed with seat portions 29 and 31 confronted with each other so that a compression coiled spring 33 is interposed therebetween while a predetermined preloading is applied to the spring 33. The compression coiled spring 33 biases the slide plate 17 in the second direction and the slide plate 19 in the first direction simultaneously so that the slide plates 17 and 19 are securely held at their neutral positions in a steady state.

Further, the slide plates 17 and 19 are integrally formed with projecting engagement pieces 35 and 37, respectively, which are parallel with each other and projected from respective slide plates upwardly in FIG. 3. When both the slide plates 17 and 19 are positioned at their neutral positions, the engagement pieces 35 and 37 are separated from each other in the transverse direction to form a predetermined clearance C into which a manipulation end 41 of a manually operated knob 39 is engaged.

As shown in FIGS. 1 and 2, the knob 39 is rotatably supported on a switch housing (not shown in the drawings) through a shaft portion 43. When the knob 39 is rotated in a clockwise direction in FIG. 1, the manipulation end 41 of the knob 39 is moved to be separated from the engagement piece 37 of the second slide plate 19 and to drive the engagement piece 35 to move the first slide plate 17 in the first direction. On the contrary, when the knob 39 is rotated in a counterclockwise direction in FIG. 1, the manipulation end 41 is moved to be separated from the engagement piece 35 of the first slide plate 17 and to drive the engagement piece 37 to move the second slide plate 19 in the second direction.

Figure 7:
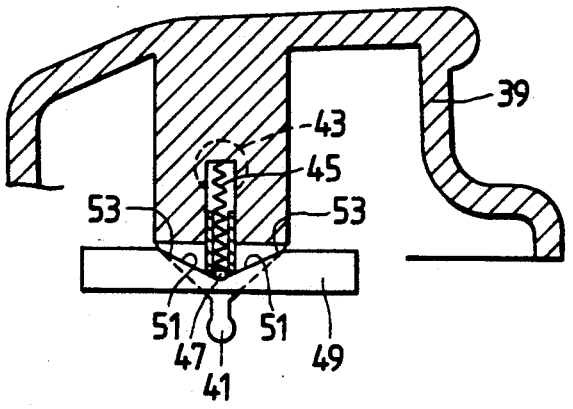
FIG. 7 is a enlarged sectional view showing a click or moderation feeling application part and a knob return mechanism in the switch mechanism.

As best shown in FIG. 7, the knob 39 is provided with a click pin 47 which is urged by a spring 45 downward from the knob 39. The pin 47 is engaged with a V-shaped planar cam plate 49 fixed to the switch housing not shown in the drawings. In conjunction with the clockwise or counterclockwise rotation of the knob 39 from its neutral position, the pin 47 is moved to slide from the most deepest portion of the V-shaped groove along a slope surface 51 of the V-shaped groove while compressing the spring 45. If the knob 39 is rotated in a clockwise or counterclockwise direction at a predetermined amount of rotation, the pin 47 runs onto a projection 53 formed on the slope 51 near the uppermost portion of the V-shaped groove, to thereby provide a click feeling or moderate feeling in the rotational operation of the knob 39.

Since the spring 45 is compressed by the pin 47 in conjunction with the clockwise or counterclockwise rotation of the knob 39, the spring 45 functions as a return spring for returning the knob 39 into its neutral position when the operator's hand is released from the knob 39.

Figure 5:
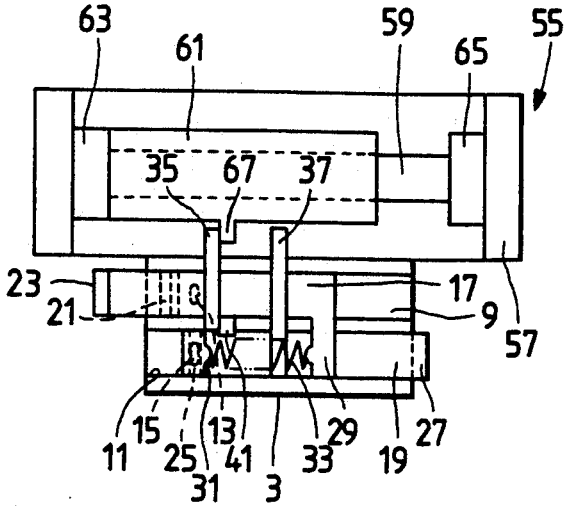
FIG. 5 is a view showing the switch device in which the first slide plate is driven for the self-holding operation mode.
Figure 6:
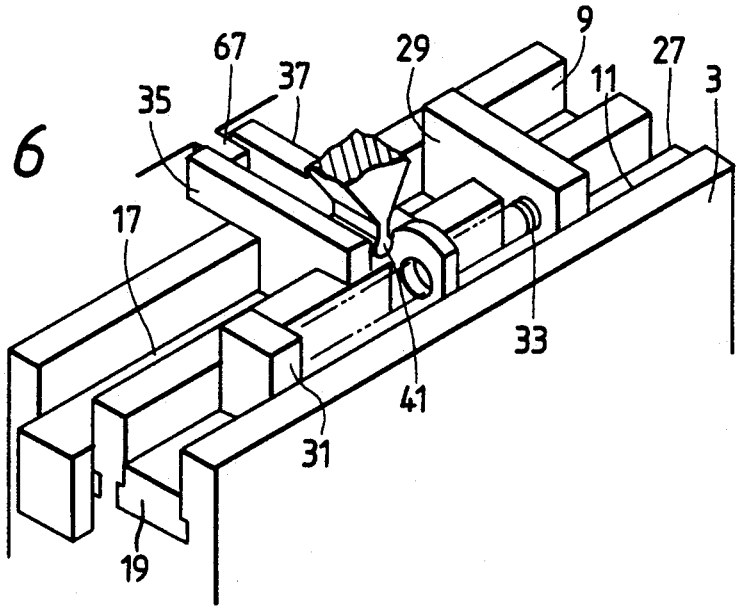
FIG. 6 is a perspective view showing a major part of the switch device.

As shown in FIGS. 2 and 5, a solenoid device 55 for holding a shifted position of the switch is attached onto one side of the microswitch casing 3 mounted onto the printed circuit board 1. The switch shifted position holding solenoid device 55 includes a guide bar 59 fixedly supported onto support portions 57 to horizontally extend in a transverse direction in FIG. 3, a movable member 61 fittingly mounted onto the guide bar 59 to be reciprocal along the guide bar 59, and electromagnetically attracting portions 63 and 65 which are respectively fixed and disposed onto left and right ends of the guide bar 59. The movable member 61 is formed with an engagement projection 67 which is disposed in the clearance C, so that the movable member 61 can be engaged with the engagement projection pieces 35 and 37, and the movement of the movable member 61 in the first and second directions is restricted by the engagement projection pieces 35 and 37.

Figure 4:
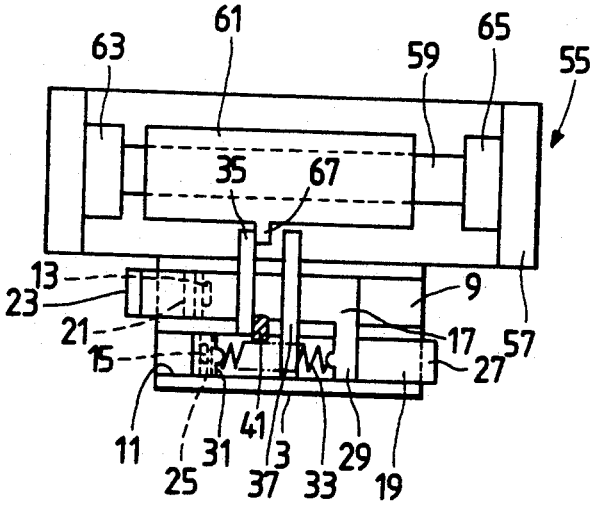
FIG. 4 is a view showing the switch device in which the first slide plate is driven for the self-returning operation mode.

The microswitch mechanisms 5 and 7, shown in FIGS. 2-4, also electrically control the switch shifted position holding solenoid device 55 such that when the actuator 13 is depressed, putting the microswitch mechanism 5 into the ON-state, the movable member 61 is electromagnetically attracted to the attraction portion 63, and when the actuator 15 is depressed, putting the microswitch mechanism 7 into the ON-state, the movable member 61 is electromagnetically attracted to the attraction portion 65.

When the knob 39 is rotated in a clockwise or counterclockwise direction to provide the click feeling, that is, when the manipulation end 41 runs onto the projection portion 53, the slide plate 17 or 19 is moved more than a predetermined amount of movement in the first or second direction. In conjunction with such movement of the slide plate 17 or 19, the movable member 61 is electromagnetically attracted to the attraction portion 63 or 65 so that the movable member 61 is also moved more than a predetermined amount in the first or second direction. Since the attraction force is set such that the magnitude of the attraction force exceeds that of the biasing force of the compression coiled spring 33 only when the movable member 61 is moved more than the predetermined amount, the movable member 61 is attracted to the portion 63 or 65 against the biasing force of the compression spring 33, to thereby hold the movable member 61 in that position.

In addition, such attraction and holding operation for the microswitch mechanisms 5 and 7 is interrupted based on the detection of load change in a power window motor due to the fact that the window glass is moved upward to its uppermost position or moved downward to its lowermost position and/or based on a return or inverse manipulation of the knob 39.

The operation of the switch device according to the present invention, which is applied, for example, to a power window device will be described hereafter.

When the window glass is to be moved upward, the knob 39 is manually rotated about the shaft portion 43 in a clockwise direction in FIG. 1 against the biasing force of the spring 45.

In conjunction with this rotational manipulation, the manipulation end 41 is moved in the left-hand side direction, i.e. in the first direction to thereby move the slide plate 17 in the first direction against the biasing force of the compression spring 33. Due to the left-hand side directional movement of the slide plate 17, the planar cam portion 21 depresses the actuator 13 by a predetermined constant amount so that the contact portion of the microswitch mechanism 5 is shifted to put the mechanism into the ON-state. Accordingly, the window glass in the power window device is raised upward.

During this operation, the movable member 61 is electromagnetically attracted to the attraction portion 63, but the movable member 61 is prevented from contacting the attraction portion 63, since the knob 39 is not rotated in the clockwise direction more than the predetermined amount of rotation and the slide plate 17 is not moved in the first direction more than the predetermined amount of movement. Therefore, the electromagnetic force between the movable member 61 and the electromagnetic attraction portion 63 is less than the biasing force of the compression spring 33. When operator's hand releases the knob 39, the knob 39 is returned to its neutral position by the biasing force of the spring 45 and the slide plate 17 is returned to its neutral position by the biasing force of the compression spring 33. As a result, the depression of the actuator 13 is interrupted simultaneously. Accordingly, the microswitch mechanism 5 is returned to the OFF-state so that the raising of the window glass is interrupted.

The above-noted operation is so-called "self-returning operation mode" or "manual operation mode" in the window glass raising operation, where the raising of the window glass is performed only when the knob 39 is manually rotated in the clockwise direction and held in that position by operator's hand.

When the knob 39 is manually rotated about the shaft portion 43 in the clockwise direction in FIG. 1 at a larger amount, i.e. more than the predetermined amount, the click or moderation pin 47 runs onto the projection portion 53 formed in the V-shaped groove near the uppermost portion of the slope 51 to thereby provide click feeling for the operator during the rotational manipulation.

When the knob 39 is rotated as noted above, the slide plate 17 is moved in the first direction with an amount of movement more than the predetermined amount, and, in conjunction therewith, the movable member 61 is moved to the attraction portion 63 in the first direction with an amount of movement more than the predetermined amount due to the electromagnetic attraction, so that the attraction force between the movable member 61 and the attraction portion 63 is made larger than the biasing force of the compression coiled spring 33. Accordingly, the movable member 61 is completely attracted to and held by the attraction portion 63 against the biasing force of the compression coiled spring 33 so that the slide plate 17 is held at that attracted position against the biasing force of the coiled spring 33 even if the knob 39 is returned to its neutral position through the biasing force of the spring 45 when the operator's hand releases the knob 39.

In this operation, even if the operator's hand releases the knob 39, the actuator 13 remains depressed to maintain the ON-state in the microswitch mechanism 5 so that the window glass in the power window device continues to move upward.

This operation is so-called "self-holding operation mode" or "automatic operation mode" for raising the window glass, where the window glass continues to move upward even when the operator's hand releases the knob 39.

In addition, if the window glass is to be moved downward, the knob 39 is manually rotated about the shaft portion 43 in a counterclockwise direction in FIG. 1 to thereby move the slide plate 19 in the second direction against the biasing force of the compression coiled spring 33. In accordance with the amount of the counterclockwise rotation of the knob 39, the manual operation mode or the automatic operation mode for moving the window glass downward is achieved in a similar fashion as described above for the upward movement of the window glass.

A switch device according to a second embodiment of the present invention will be described with reference to FIGS. 8 to 13. In FIGS. 8 to 13, parts corresponding functionally to those which have been described with reference to the drawings in the first embodiment are therefore designated by the similar reference numerals or characters.

Figure 9:
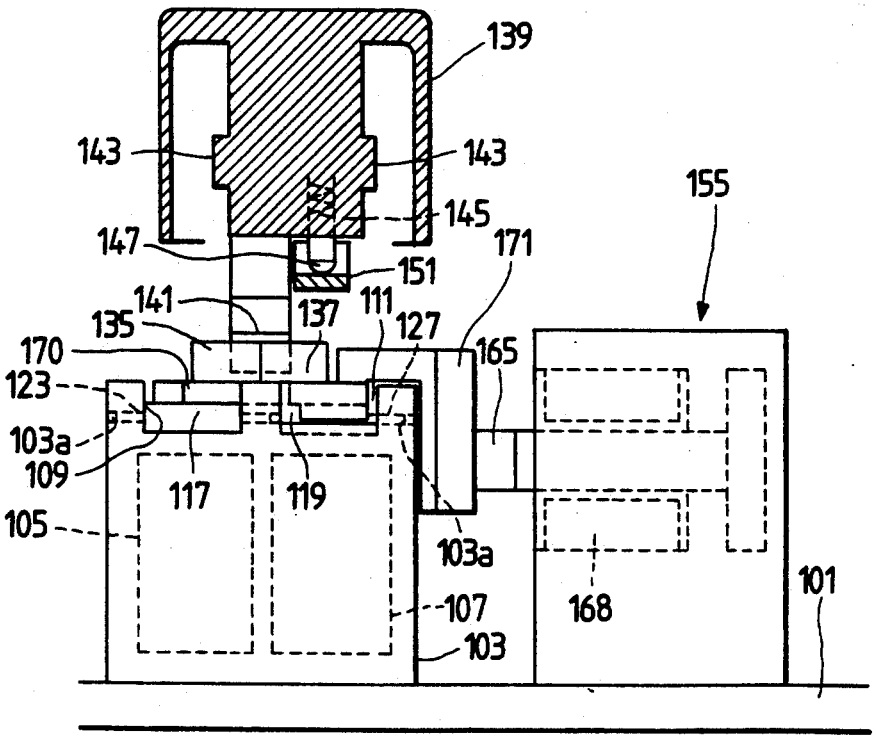
FIG. 9 is a front view as viewed from left-hand side in FIG. 8.
Figure 10:
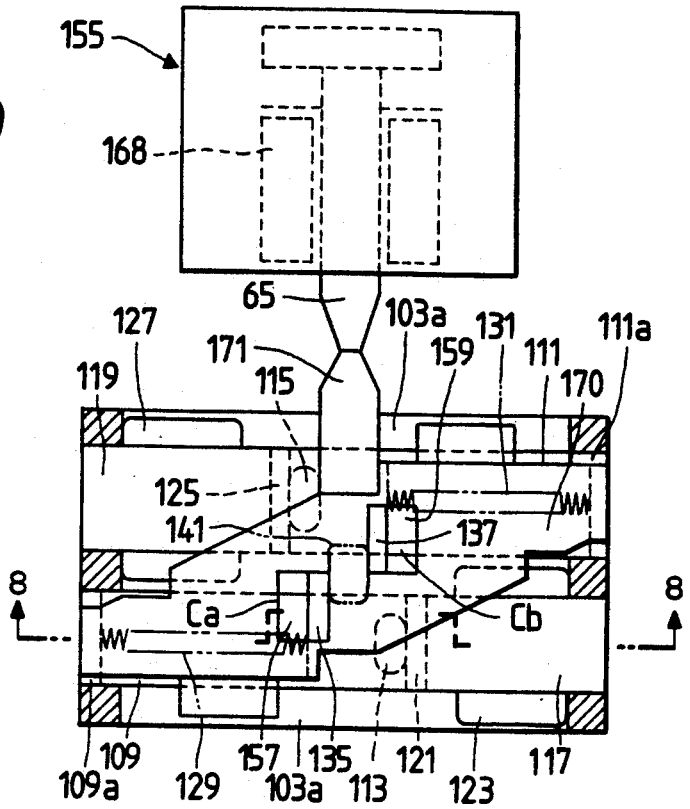
FIG. 10 is a view showing the switch device of the second embodiment in which first and second slide plates and a lock plate are in their neutral position.
Figure 11:
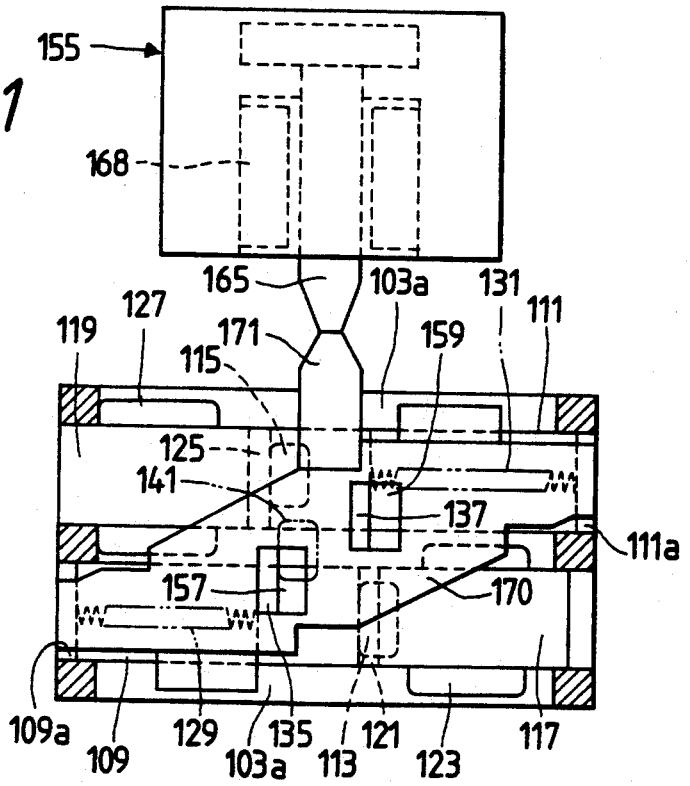
FIG. 11 is a view showing the switch device of the second embodiment in which the first slide plate is driven for the self-returning operation mode.

As shown in FIGS. 9 and 10, in the switch device according to the second embodiment of the present invention, three slits 103*a* are formed in three upstanding walls of the microswitch casing 103. A guide portion 109 for the first slide plate 17 is defined between two of the upstanding walls, and also a guide portion 111 for the second slide plate 119 is defined between two of the upstanding walls. The first slide plate 117 is formed with engagement stopper pieces 123 which is slidably fitted into two of the slits 103*a*. The engagement stopper pieces 123 of the first slide plate 117 are capable of abutting against right-end walls of the slits 103*a*, respectively, to thereby prevent the movement of the first slide plate 117 in the second direction from its neutral position. Similarly, the second slide plate 119 is formed with the engagement stopper pieces 127 which are slidably fitted into two of the slits 103*a* and are abuttable against respective left-end walls of the slits 103*a* to restrict the movement of the second slide plate 119.

A spring seat 109*a* is formed on the left-end of the guide portion 109 defined between the upstanding walls in which the slits 103*a* for the first slide plate 117 are formed. Similarly, a spring seat 111*a* is formed on the right-end of the guide portion 111 defined between the upstanding walls in which the slits 103*a* for the second slide plate 119 are formed. A compression coiled spring 129 is interposed between the spring seat 109*a* and the first slide plate 117 while a predetermined preloading is applied to the spring 129, whereas another compression spring 131 is interposed between the spring seat 111*a* and the second slide plate 119 while a predetermined preloading is applied to the spring 131. The compression coiled spring 129 forces the first slide plate 117 in the second direction and the compression coiled spring 131 forces the second slide plate 119 in the first direction so that the first and second slide plates 117 and 119 are held thereby at their respective neutral positions shown in FIG. 10 in a steady manner.

The slide plates 117 and 119 are integrally formed with engagement projection pieces 135 and 137, respectively, which are projected upwardly therefrom as shown in FIG. 9. As shown in FIG. 10, when both the slide plates are in their neutral positions, the engagement projections 135 and 137 are separated by a predetermined clearance in a transverse direction so that the manipulation end 141 of the knob 139 is engaged into the clearance.

A lock plate 170 reciprocal in the transverse direction is laid in and engaged with both the engagement portions 109 and 111 so that the lock plate 170 is piled on the slide plates 117 and 119. The lock plate 170 is formed with engagement openings 157 and 159 through which engagement projection pieces 135 and 137 of the first and second slide plates 117 and 119 are respectively passed and projected so as to be engageable therewith. The transverse dimension of the openings 157 and 159 is determined such that, as shown in FIG. 10, the engagement projecting piece 135 and the engagement opening 157 form a predetermined clearance Ca at a left-hand side of the engagement projecting piece 135 when both the first slide plate 117 and the lock plate 170 are in their neutral positions, and, similarly, the engagement projecting piece 137 and the engagement opening 159 form a predetermined clearance Cb at a right-hand side of the engagement projecting piece 137 when both the second slide plate 119 and the lock plate 170 are in their neutral positions. In this embodiment, the clearance Ca is equal to the clearance Cb.

The lock plate 170 is engaged at its left-hand end portion with the compression coiled spring 129 and at its right-hand end portion with the compression coiled spring 131 so that due to the biasing force of these springs 129 and 131 the lock plate 170 are held in its neutral position as shown in FIG. 10.

According to the above-noted arrangement, the lock plate 170 is held at its neutral position when the first slide plate 117 is moved in the first direction from its neutral position within an amount of movement corresponding to the predetermined clearance Ca and when the second slide plate 119 is moved in the second direction from its neutral position within an amount of movement corresponding to the predetermined clearance Cb. That is, at the time when the first slide plate 117 has been moved in the first direction from its neutral position with the amount corresponding the clearance Ca, the engagement projecting piece 135 abuts against the left-hand end portion of the opening 157 to engage the first slide plate 117 with the lock plate 170 so that the lock plate 170 is associated with the first slide plate 117 to be moved in the first direction from its neutral position together with the first slide plate 117 during the further movement of the slide plate 117. Similarly, at the time when the second slide plate 119 has been moved in the second direction from its neutral position with the amount corresponding to the clearance Cb, the engagement projecting piece 137 abuts against the right-hand end portion of the opening 159 to engage the second slide plate 119 with the lock plate 170 so that the lock plate 170 is associated with the second slide plate 119 to be moved in the second direction from its neutral position together with the second slide plate 119 during the further movement of the slide plate 119.

The lock plate 170 is formed with a locking projection portion 171 at its central portion in the transverse direction as shown in FIG. 10.

As shown in FIGS. 9 and 10, a solenoid device 155 for holding a switch shifted position is mounted on the printed circuit board 101 at one side of the microswitch casing 103. The switch shifted position holding solenoid device 155 includes a movable member 165 movable in directions perpendicular to directions of movement of the lock plate 170, that is, movable in left and right hand directions in FIG. 9. The solenoid device 155 further includes a solenoid 168 for driving the movable member 165 in the left and right directions in FIG. 9.

Figure 12:
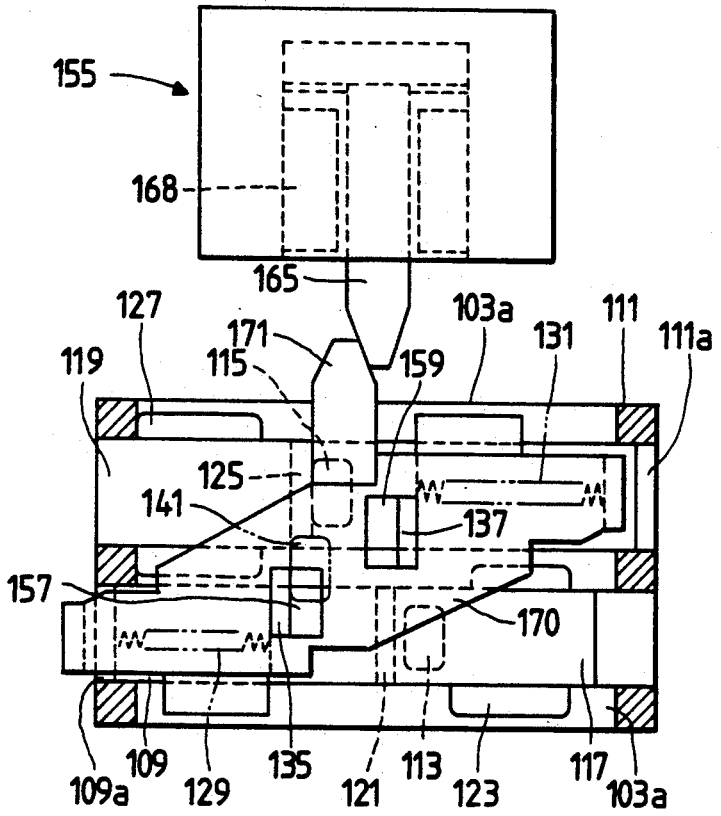
FIG. 12 is a view showing the switch device of the second embodiment in which the first slide plate is driven for the self-holding operation mode.

The movable member 165 is urged by a return spring not shown in the drawing to be positioned at its rearward position shown in FIGS. 9 and 10 when the solenoid 168 is in non-electromagnetic (non-excited) state. When the solenoid 168 is excited, the movable member 165 is driven forward to be positioned at its forward position shown in FIG. 12. The solenoid device 155 is designed such that when the lock plate 170 is in its neutral position, the movable member 165 is confronted with the locking projection portion 171 so that the lock plate 170 is free to move in the first and second directions from its neutral position regardless of the non-excited and excited states of the solenoid 168. On the contrary, as shown in FIG. 12, when the lock plate 170 is moved in the first direction from its neutral position, the solenoid 168 is excited to drive the movable member 165 forward so that the movable member 165 is engaged with the right-hand side of the locking projection portion 171 to prevent the lock plate 170 from being returned in the second direction and to hold the lock plate 170 at that position. Similarly, when the lock plate 170 is moved in the second direction from its neutral position, the solenoid 168 is excited to drive the movable member 165 forward so that the movable member 165 is engaged with the left-hand side of the locking projection portion 171 to prevent the lock plate 170 from being returned in the first direction and to hold the lock plate 170 at that position.

The operation of the switch device according to the second embodiment of the present invention will be described hereafter.

Figure 8:
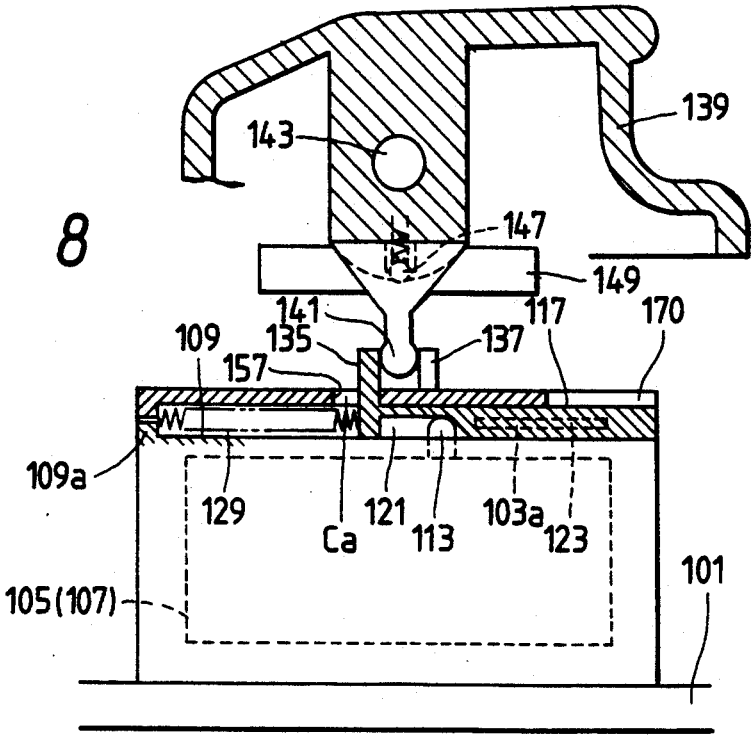
FIG. 8 is a sectional view taken along line 8—8 in FIG. 10, showing a switch device according to a second embodiment of the present invention, in which the present invention is applied as a switch device for a power window in an automotive vehicle.
Figure 13:
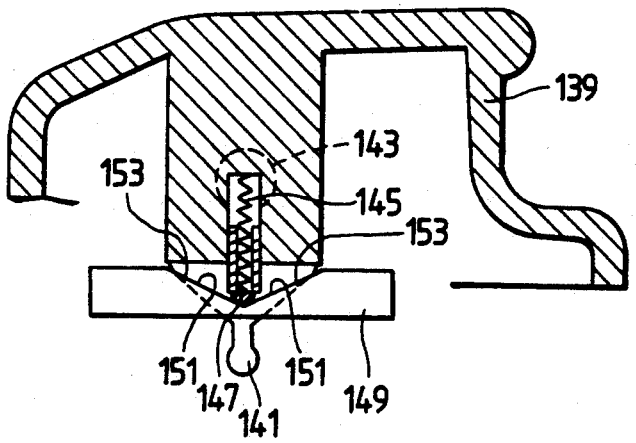
FIG. 13 is an enlarged sectional view showing a click or moderation feeling application part and a return mechanism for a knob in the switch device of the second embodiment.

When the window glass is to be moved upward, the knob 139 is manually rotated about the shaft portion 143 in a clockwise direction in FIG. 8 against the biasing force of the spring 145 shown in FIG. 13.

As can be seen with reference to FIG. 8, in conjunction with this rotational manipulation, the manipulation end 141 is moved in the left-hand side direction, i.e. in the first direction to thereby move the engagement projection piece 135, so that the first slide plate 117 is moved in the first direction from its neutral position against the biasing force of the compression spring 129. Due to the left-hand side directional movement of the slide plate 117, the planar cam portion 121 depresses the actuator 113 by a predetermined constant amount so that the contact portion of the microswitch mechanism 105 is shifted to put the mechanism into the ON-state. Accordingly, the window glass in the power window device is raised upward.

During this operation, the engagement projection piece 135 is moved in the first direction within the engagement opening 157, but the lock plate 170 is not moved from its neutral position so that even if the solenoid 168 is excited to move the movable member 165 forward, the movable member 165 is only brought into contact with the locking projection portion 171 but not engaged therewith.

When the operator's hand is released from the knob 139, the knob 139 is returned to its neutral position by the biasing force of the spring 145 and the slide plate 117 is returned to its neutral position by the biasing force of the compression spring 129. As a result, the depression for the actuator 113 is interrupted simultaneously. Accordingly, the microswitch mechanism 105 is returned to the OFF-state so that the raising of the window glass is interrupted.

The above-noted operation is so-called "self-returning operation mode" or "manual operation mode" in the window glass raising operation, where the raising of the window glass is performed only when the knob 139 is manually rotated in the clockwise direction and held in that position by operator's hand.

When the knob 139 is manually rotated about the shaft portion 143 in the clockwise direction in FIG. 8 at a larger amount, i.e. more than the predetermined amount, the click pin 147 runs onto the projection portion 153 formed in the V-shaped groove near the uppermost portion of the slope 151 to thereby provide click feeling for the operator during the rotational manipulation.

When the knob 139 is rotated as noted above, the engagement projection piece 135 is moved with a larger amount and the slide plate 117 is moved in the first direction with an amount of the movement more than the predetermined amount, and, in conjunction therewith, the engagement projection piece 135 is brought into abutment and engagement with the left-hand end portion of the engagement opening 157 of the lock plate 170, so that the lock plate 170 is moved in the first direction from its neutral position together with the first slide plate 117 against the biasing force of the compression coiled springs 129 and 131. Further, since the solenoid 168 is excited to drive the movable member 165 forward under this state, the movable member 165 is engaged with the right-hand end portion of the locking projection portion 171 as shown in FIG. 12.

Therefore, the lock plate 170 is held at that position and prevented from being moved together with the first slide plate 117 to be returned to its neutral position. During this operation, if the operator's hand is released from the knob 139 to thereby return the knob 139 to its neutral position due to the biasing force of the spring 145, the slide plate 117 is returned due to the biasing force of the compression coiled spring 129 in the second direction with the amount corresponding to the clearance Ca in the engagement opening 157, but the further returning of the slide plate 117 is prevented by the lock plate 170, and the slide plate 117 is held at that position where the actuator 113 is continued to be depressed downward by the predetermined constant amount through the planar cam portion 121.

Therefore, in this operation, even if the operator's hand is released from the knob 139, the actuator 113 is continued to be depressed to maintain the ON-state in the microswitch mechanism 105 so that the window glass in the power window device is continued to be moved upward.

This operation is so-called "self-holding operation mode" or "automatic operation mode" for raising the window glass, where the window glass continues to move upward even when the operator's hand is released from the knob 139.

Contrary to the above-noted operations for raising the window glass, when the window glass is to be moved downward, the knob 139 is manually rotated about the shaft portion 143 in a counterclockwise direction in FIG. 8 against the biasing force of the spring 145.

In conjunction with this rotational manipulation, the manipulation end 141 is moved in the right-hand direction, i.e. in the second direction to thereby move the engagement projection piece 137 in the second direction so that the slide plate 119 is moved in the second direction from its neutral position against the biasing force of the compression spring 131. Due to the right-hand directional movement of the slide plate 119, the planar cam portion 125 depresses the actuator 115 by a predetermined constant amount so that the contact portion of the microswitch mechanism 107 is shifted to put the mechanism into the ON-state. Accordingly, the window glass in the power window device is moved downward.

During this operation, the engagement projection piece 137 is moved in the second direction within the engagement opening 159, but the lock plate 170 is not moved from its neutral position, so that even when the solenoid 168 is excited to move the movable member 165 forwardly, the movable member 165 is only brought into contact with the locking projection portion 171 but not engaged therewith.

When the operator's hand is released from the knob 139, the knob 139 is returned to its neutral position by the biasing force of the spring 145 and the slide plate 119 is returned to its neutral position by the biasing force of the compression spring 131. As a result, the depression for the actuator 115 is interrupted simultaneously. Accordingly, the microswitch mechanism 107 is returned to the OFF-state so that the downward movement of the window glass is interrupted.

The above-noted operation is so-called "self-returning operation mode" or "manual operation mode" in the window glass lowering operation, where the lowering of the window glass is performed only when the knob 139 is manually rotated in the counterclockwise direction and held in that position by the operator's hand.

When the knob 139 is manually rotated about the shaft portion 143 in the counterclockwise direction in FIG. 8 at a larger amount, i.e. more than the predetermined amount, the click pin 147 runs onto the projection portion 153 formed in the V-shaped groove near the uppermost portion of the slope 151 thereby provide click feeling for the operator during the rotational manipulation.

When the knob 139 is rotated as noted above, the engagement projection piece 137 is moved with a larger amount and the slide plate 119 is moved in the second direction with an amount of the movement more than the predetermined amount, and, in conjunction therewith, the engagement projection piece 137 is brought into abutment and engagement with the right-hand end portion of the engagement opening 159 of the lock plate 170 so that the lock plate is moved in the second direction from its neutral position together with the second slide plate 119 against the biasing force of the compression coiled springs 29 and 31. Further, since the solenoid 168 is excited to drive the movable member 165 forward under this state, the movable member 165 is engaged with the left-hand end portion of the locking projection portion 171.

Therefore, the lock plate 170 is held at that position and prevented from being moved together with the second slide plate 119 to be returned to its neutral position. During this operation, if the operator's hand is released from the knob 139 to thereby return the knob 139 to its neutral position due to the biasing force of the spring 145, the slide plate 119 is returned due to the biasing force of the compression coiled spring 31 in the first direction with the amount corresponding to the clearance Cb in the engagement opening 159, but the further returning of the slide plate 119 is prevented by the lock plate 170, and the slide plate 119 is held at that position where the actuator 115 is continued to be depressed downward by the predetermined constant amount through the planar cam portion 125.

Therefore, in this operation, even if the operator's hand is released from the knob 139, the actuator 115 is continued to be depressed, maintaining the ON-state in the microswitch mechanism 107 so that the window glass in the power window device continues to move downward.

This operation is so-called "self-holding operation mode" or "automatic operation mode" for lowering or moving down the window glass, where the window glass is continues to move downward even when the operator's hand is released from the knob 139.

In addition, during these operations as noted above, the excitation of the solenoid 168 is interrupted based on the detection of load change in a power window motor due to the fact that the window glass has reached its uppermost position or its lowermost position and/or based on a return or inverse manipulation of the knob 139 by the operator.

With reference to FIGS. 14 to 24, a switch device according to a third embodiment of the present invention will be described hereafter. Parts corresponding functionally to those in the former embodiments are therefore designated by similar reference numerals or characters.

In this embodiment, a single slide plate 217 is fitted to both the guide portions 209 and 211 to be slid in the right and left hand side directions, i.e. the transverse directions in FIGS. 14 to 17 and 19 to 24. The slide plate 217 has a first planar cam portion 221 (see FIG. 20) and a second planar cam portion 225 (see FIG. 19), which are respectively formed with substantially trapezoid recesses extending in the opposite directions with respect to each other. When the slide plate 217 is moved in the left-hand direction, i.e. the first direction from its neutral position shown in FIGS. 14, 19 and 20, the actuator 213 is depressed downward by a predetermined constant amount through the first planar cam portion 221. When the slide plate 217 is moved in the right-hand direction, i.e. the second direction from its neutral position, the actuator 215 is depressed downward by a predetermined constant amount through the second planar cam portion 225.

Figure 19:
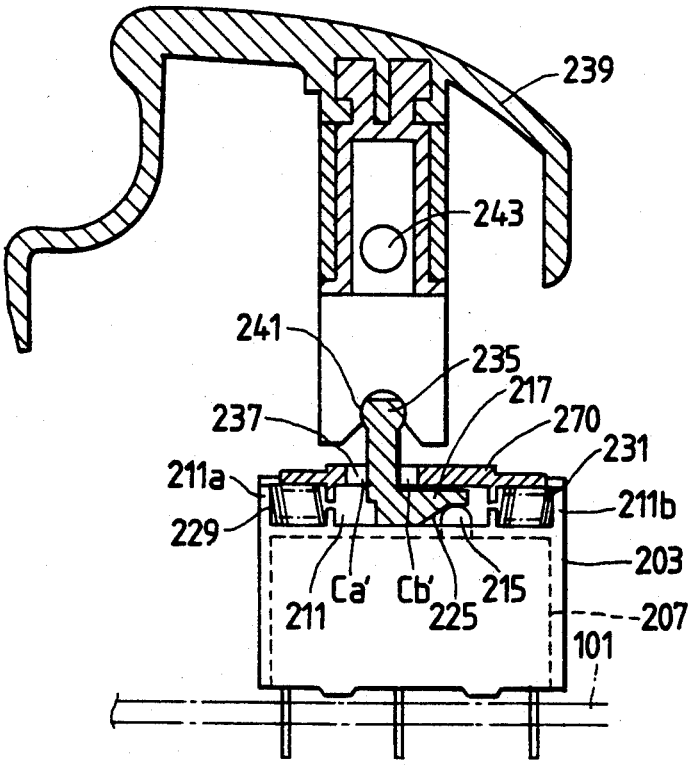
FIG. 19 is a sectional view taken along line 19—19 in FIG. 14.

The slide plate 217 is integrally formed with an engagement projecting piece 235 with which a manipulation end 241 of a manipulation knob 239 is engaged as shown in FIG. 19.

Also fitted into the guide portions 209 and 211 is a lock plate 270 which is slidable in the transverse directions relative to the casing 203 and piled on the slide plate 217. The lock plate 270 is reciprocal relative to the casing 203 in the transverse directions but restricted to move in vertical directions by the engagement between the engagement stopper projection 233 formed thereon and the slits 35 formed in the microswitch casing 203. The lock plate 270 is formed with an opening 237 through which the engagement projection piece 235 is projected upward. The opening 237 and the engagement projection piece 235 are operatively engageable with each other.

Figure 14:
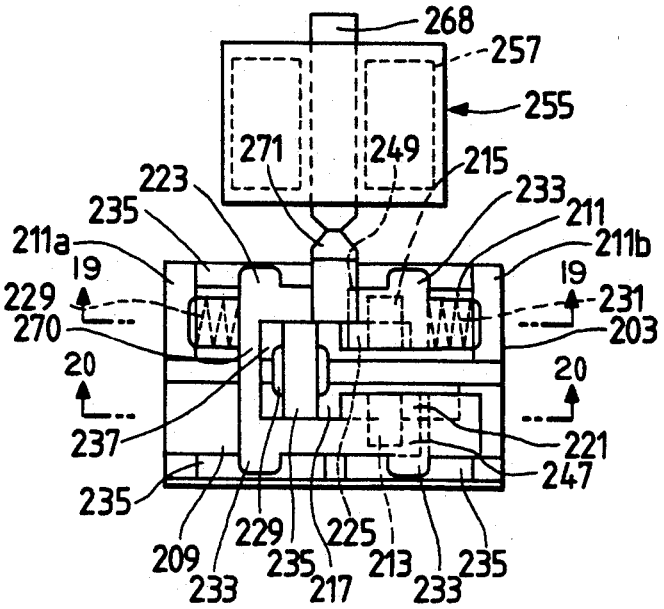
FIG. 14 is a view showing a switch device for a power window in an automotive vehicle according to a third embodiment of the present invention, in which a slide plate and a lock plate are in their neutral positions.
Figure 15:
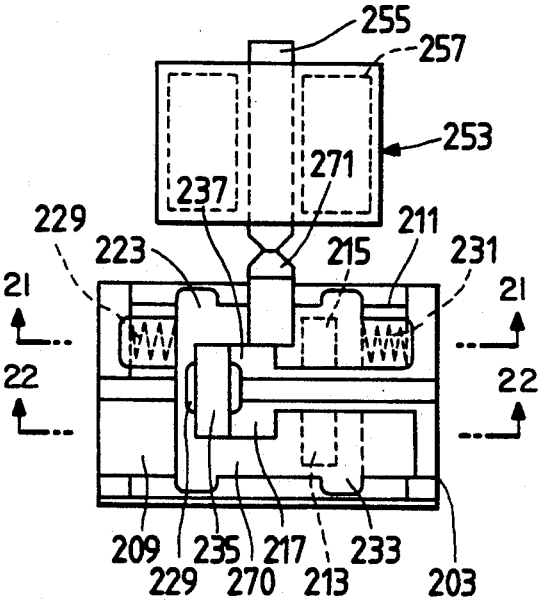
FIG. 15 is a view showing the switch device of the third embodiment in which the slide plate is driven for the self-returning operation mode.
Figure 20:
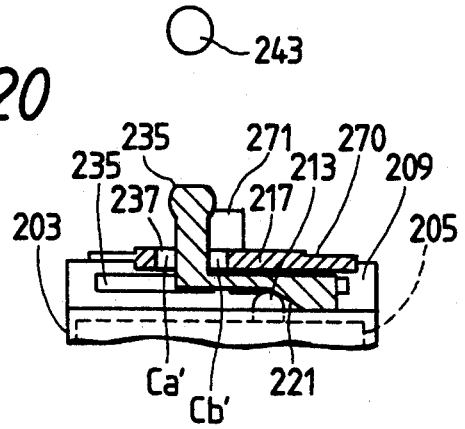
FIG. 20 is a sectional view taken along line 20—20 in FIG. 14.
Figure 21:
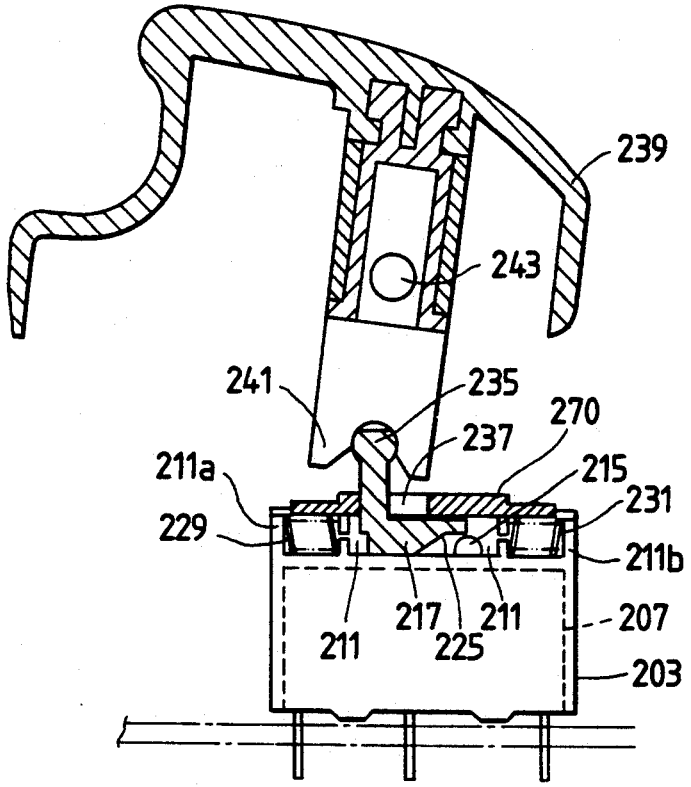
FIG. 21 is a sectional view taken along line 21—21 in FIG. 15.
Figure 22:
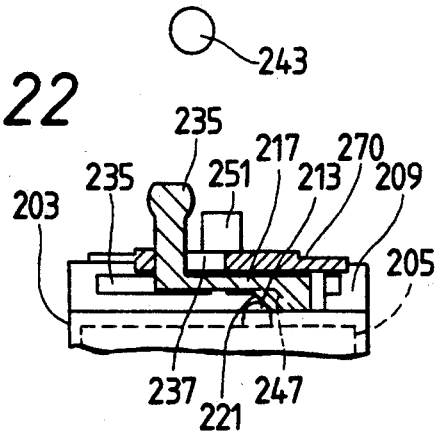
FIG. 22 is a sectional view taken along line 22—22 in FIG. 15.
Figure 23:
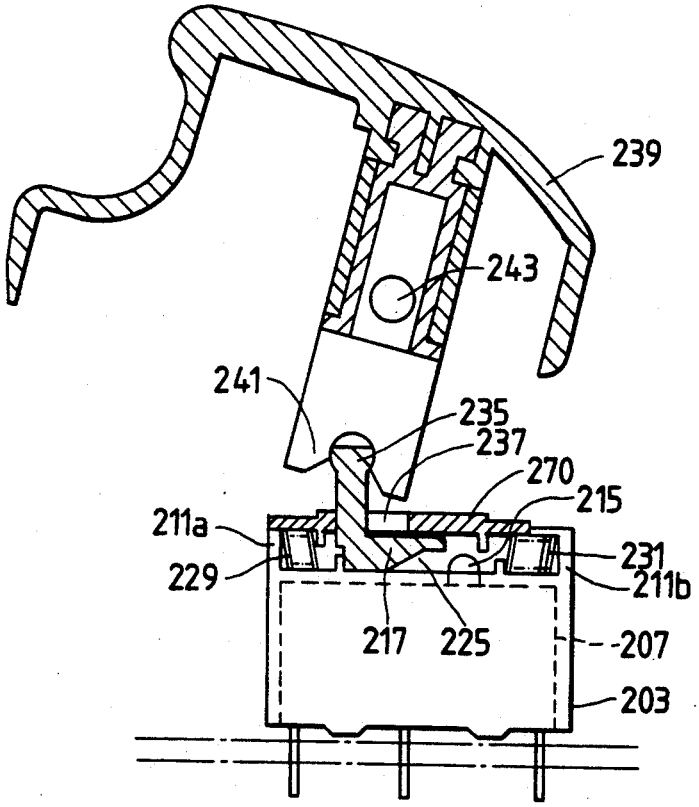
FIG. 23 is a sectional view taken along line 23—23 in FIG. 16.
Figure 24:
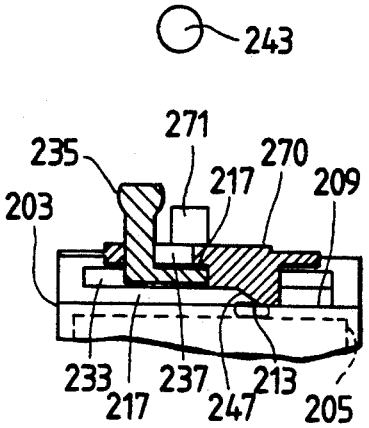
FIG. 24 is a sectional view taken along line 24—24 in FIG. 16.

As shown in FIGS. 14, 19 and 20, when both the slide plate 217 and the lock plate 270 are in their neutral positions, a clearance Ca' and a clearance Cb' are respectively formed on left and right hand sides of the engagement projection piece 235 within the opening 237. In this embodiment, the opening 237 has dimensions such that the clearance Ca' is equal to the clearance Cb'.

A compression coiled spring 229 is interposed between the left end portion of the lock plate 270 and the spring seat portion **211*a* of the microswitch casing 203 while a compression coiled spring 231 is interposed between the right end portion of the lock plate 270 and the spring seat portion 211b of the casing 203 so that the lock plate 270** is held at its neutral position due to the biasing force thereof.

According to the above-noted arrangement, the lock plate 270 is held at its neutral position when the slide plate 217 is moved in the first direction from its neutral position within an amount of movement corresponding to the predetermined clearance Ca' or in the second direction from its neutral position within an amount of movement corresponding to the predetermined clearance Cb'. That is, at the time when the slide plate 217 has been moved in the first direction from its neutral position with the amount corresponding the clearance Ca', the engagement projecting piece 235 abuts against the left-hand end portion of the opening 237 to engage the slide plate 217 with the lock plate 270 so that the lock plate 270 is associated with the slide plate 217 to be moved in the first direction from its neutral position together with the slide plate 217 during the further movement of the slide plate 217. Similarly, at the time when the slide plate 217 has been moved in the second direction from its neutral position with the amount corresponding to the clearance Cb', the engagement projecting piece 235 abuts against the right end portion of the opening 137 to engage the slide plate 217 with the lock plate 270 so that the lock plate 270 is associated with the slide plate 217 to be moved in the second direction from its neutral position together with the slide plate 217 during the further movement of the slide plate 217.

The lock plate 270 is provided at its bottom with a third planar cam portion 247 formed with a substantially trapezoidal recess, which depresses the actuator 213 downward by a predetermined constant amount when the locking plate 270 is moved in the first direction from its neutral position. The lock plate 270 is further provided at its bottom with a fourth planar cam portion 249 formed with a substantially trapezoidal recess, which depresses the actuator 215 downward by a predetermined constant amount when the lock plate 270 is moved in the second direction from its neutral position.

The lock plate 270 is further provided at its central portion with a locking projection portion 271 in an integral manner.

The solenoid device 255 similar to that in the second embodiment is mounted on the printed circuit board 201 at one side of the casing 203.

Figure 25:
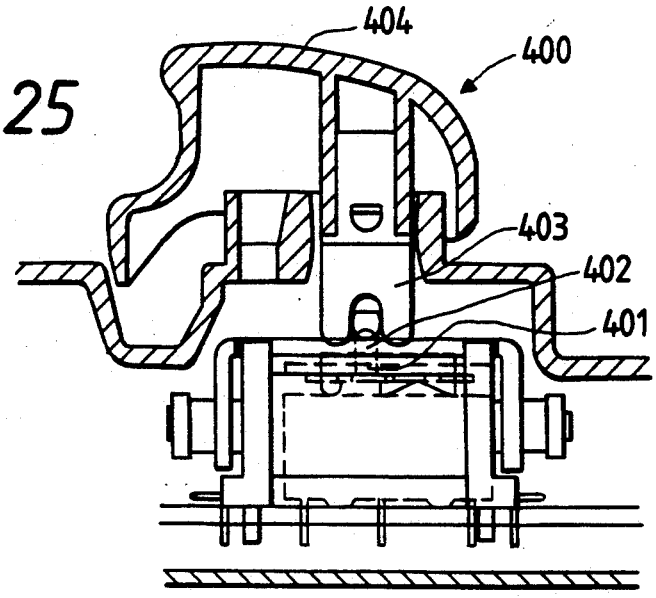
FIG. 25 is a sectional view showing a switch device according to fourth embodiment of the present invention.
Figure 26:
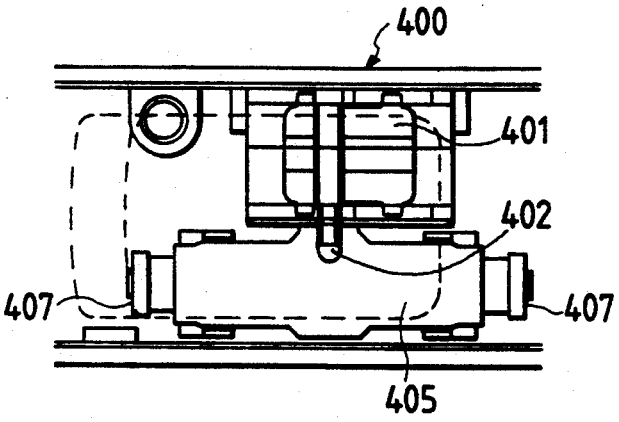
FIG. 26 is a view showing the switch device according to the fourth embodiment of the present invention.
Figure 27:
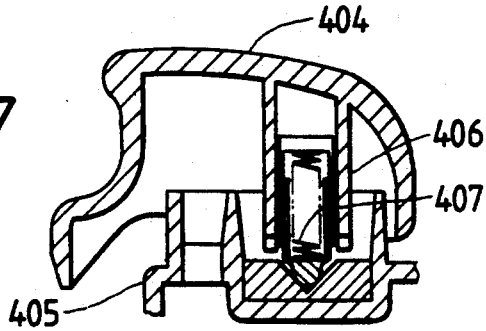
FIG. 27 is a view showing a moderation or click mechanism in the switch device according to the fourth embodiment.

Alternatively, as shown in FIGS. 25, 26 and 27, the single slide plate of this embodiment could be used in conjunction with the first embodiment, in which the lock plate would be omitted and a solenoid device similar to that in the first embodiment is directly coupled to the slide plate. The slide plate would have an engagement projection and be held in a neutral position by biasing springs located both sides of the slide plate or by a biasing spring of a moderation or click mechanism.

The knob 239 is rotatably supported on the switch housing not shown in the drawing through the shaft portion 243 thereof so that when the knob 239 is manually rotated in the clockwise direction from its neutral position in FIG. 19, the slide plate 217 is driven to move in the first direction. When the knob 239 is manually rotated in the counterclockwise direction from its neutral position, the slide plate 217 is driven to move in the second direction. The knob 239 is biased toward its neutral position by the return spring means not shown in the drawings. Also, the click or moderation feeling application means is provided to inform the operator through the click or moderate feeling that the knob 239 is rotated more than predetermined amount during the rotational manipulation.

The operation of the switch device according to the third embodiment of the present invention will be described hereafter.

When the window glass is to be moved upward, the knob 239 is manually rotated about the shaft portion 243 in a clockwise direction in FIG. 19.

In conjunction with this rotational manipulation, the manipulation end 241 is moved in the left-hand direction, i.e. in the first direction to thereby move the engagement projection piece 235 so that the slide plate 217 is moved in the first direction from its neutral position. Due to the left-hand directional movement of the slide plate 217, the first planar cam portion 221 depresses the actuator 213 by a predetermined constant amount so that the contact portion of the microswitch mechanism 205 is shifted to put the mechanism into the ON-state. Accordingly, the window glass in the power window device is raised upward.

During this operation, the engagement projection piece 235 is moved in the first direction within the engagement opening 237 but the lock plate 270 is not moved from its neutral position, so that even when the solenoid 268 is excited to move the movable member 255 forward, the movable member 255 is only brought into contact with the locking projection portion 271 but not engaged therewith.

When the operator's hand is released from the knob 239, the knob 239 is returned to its neutral position by the biasing force of the spring not shown in the drawings and the slide plate 217 is returned to its neutral position. As a result, the depression of the actuator 213 is interrupted simultaneously. Accordingly, the microswitch mechanism 205 is returned to the OFF-state so that the raising of the window glass is interrupted.

The above-noted operation is so-called "self-returning operation mode" or "manual operation mode" in the window glass raising operation, where the raising of the window glass is performed during only when the knob 239 is manually rotated in the clockwise direction and held in that position by the operator's hand.

Figure 16:
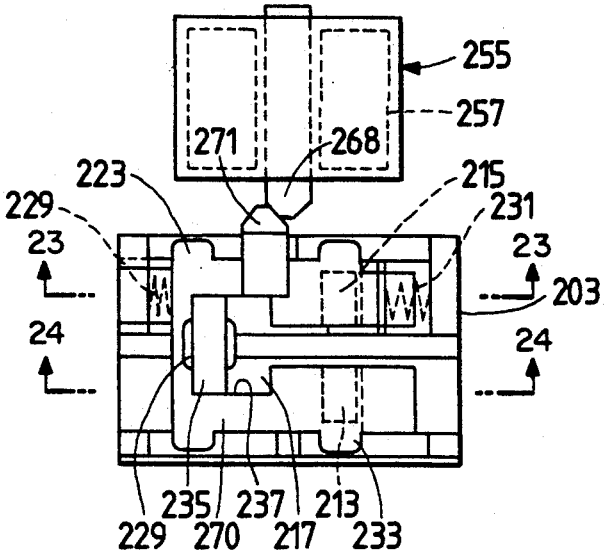
FIG. 16 is a view showing the switch device of the third embodiment in which the slide plate is driven for self-holding operation mode.

When the knob 239 is manually rotated about the shaft portion 243 in the clockwise direction in FIG. 19 at a larger amount, i.e. more than the predetermined amount, the click feeling is provided for the operator during the rotational manipulation. When the knob 239 is rotated as noted above, the slide plate 217 is moved in the first direction with an amount of the movement more than the predetermined amount, and, in conjunction therewith, the engagement projection piece 235 is brought into abutment and engagement with the left-hand end portion of the engagement opening 237 of the lock plate 270 so that the lock plate 270 is moved in the first direction from its neutral position together with the slide plate 217 against the biasing force of the compression coiled spring 229. Therefore, the third planar cam portion 247 also depresses the actuator 213 by the predetermined constant amount. Further, since the solenoid 268 is excited to drive the movable member 255 forward under this state, the movable member 255 is engaged with the right end portion of the locking projection portion 171 as shown in FIG. 16.

Therefore, the lock plate 270 is held at that position and prevented from being moved together with the slide plate 217 to be returned to its neutral position.

Figure 17:
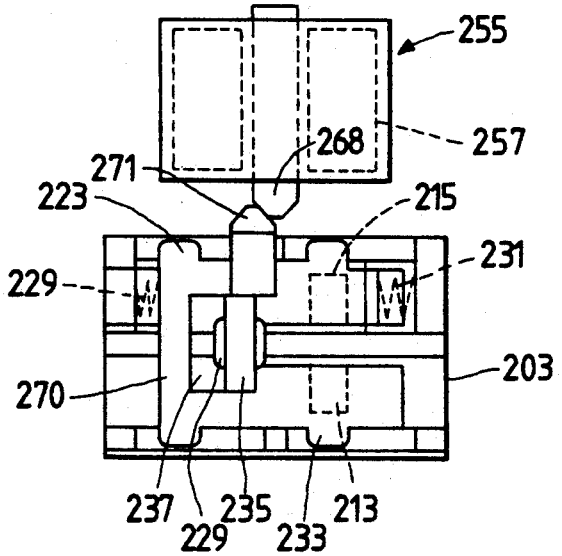
FIG. 17 is a view showing the switch device of the third embodiment in the self-holding operation mode in which the slide plate is held by the lock plate.
Figure 18:
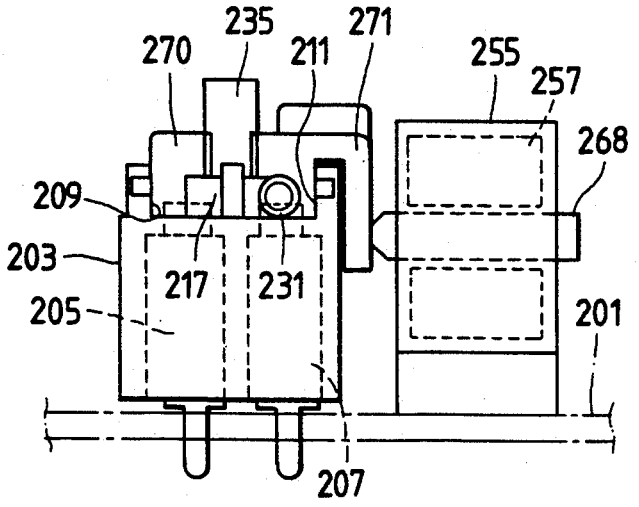
FIG. 18 is a front view as viewed from left-hand side in FIG. 14.

During this operation, if the operator's hand is released from the knob 239 to thereby return the knob 239 to its neutral position, the slide plate 217 is returned to its neutral position as shown in FIG. 17, but the actuator 213 remains depressed by the third planar cam portion 247 by the predetermined constant amount.

Therefore, in this operation, even if the operator's hand is released from the knob 239, the actuator 213 remains depressed, maintaining the ON-state in the microswitch mechanism 205 so that the window glass in the power window device continues to move upward.

This operation is so-called "self-holding operation mode" or "automatic operation mode" for raising the window glass, where the window glass continues to move upward even when the operator's hand releases the knob 239.

Contrary to the above-noted operations for raising the window glass, when the window glass is to be moved downward, the knob 239 is manually rotated about the shaft portion 243 in a counterclockwise direction in FIG. 19.

In conjunction with this rotational manipulation, the manipulation end 241 is moved in the right-hand direction, i.e. in the second direction to thereby move the engagement projection piece 235 in the second direction so that the slide plate 217 is moved in the second direction from its neutral position. Due to the right-hand directional movement of the slide plate 217, the second planar cam portion 225 depresses the actuator 215 by a predetermined constant amount so that the contact portion of the microswitch mechanism 207 is shifted to put the mechanism into the ON-state. Accordingly, the window glass in the power window device is moved downward.

During this operation, the engagement projection piece 235 is moved in the second direction within the engagement opening 237, but the lock plate 270 is not moved from its neutral position so that even when the solenoid 268 is excited to move the movable member 255 forward, the movable member 255 is only brought into contact with the locking projection portion 271 but not engaged therewith.

When operator's hand is released from the knob 239, the knob 239 is returned to its neutral position by the biasing force of the return spring and the slide plate 217 is returned to its neutral position. As a result, the depression for the actuator 215 is interrupted simultaneously. Accordingly, the microswitch mechanism 207 is returned to the OFF-state so that the downward movement of the window glass is interrupted.

The above-noted operation is so-called "self-returning operation mode" or "manual operation mode" in the window glass lowering operation, where the lowering of the window glass is performed during only when the knob 239 is manually rotated in the counterclockwise direction and held in that position by operator's hand.

When the knob 239 is manually rotated about the shaft portion 243 in the counterclockwise direction in FIG. 19 at a larger amount, i.e. more than the predetermined amount, the click feeling is provided for the operator during the rotational manipulation.

When the knob 239 is rotated as noted above, the slide plate 217 is moved in the second direction with an amount of the movement more than the predetermined amount, and, in conjunction therewith, the engagement projection piece 235 is brought into abutment and engagement with the right-hand end portion of the engagement opening 237 of the lock plate 270 so that the lock plate 270 is moved in the second direction from its neutral position together with the slide plate 217 against the biasing force of the compression coiled spring 231. Therefore, the fourth planar cam portion 249 depresses the actuator 215 by the predetermined constant amount. Further, since the solenoid 268 is excited to drive the movable member 255 forward under this state, the movable member 255 is engaged with the left-hand end portion of the locking projection portion 271.

Therefore, the lock plate 270 is held at that position and prevented from being moved together with the slide plate 217 to be returned to its neutral position. During this operation, if the operator's hand releases the knob 239 to thereby return the knob 239 to its neutral position, the slide plate 217 is returned due to the biasing force of the compression coiled spring 231 to its neutral position, but the lock plate 270 is held at that position so that the actuator 215 is continued to be depressed downward by the predetermined constant amount through the fourth planar cam portion 249.

Therefore, in this operation, even if the operator's hand releases the knob 239, the actuator 215 continues to be depressed, maintaining the ON-state in the microswitch mechanism 207 so that the window glass in the power window device continues to move downward.

This operation is so-called "self-holding operation mode" or "automatic operation mode" for lowering or moving down the window glass, where the window glass is continues to move downward even when the operator's hand releases the knob 239.

In addition, during these operations as noted above, the excitation of the solenoid 268 is interrupted based on the detection of a load change in a power window motor due to the fact that the wind glass has reached its uppermost position or its lowermost position and/or based on a return or inverse manipulation of the knob 239 by the operator.

FIGS. 25, 26 and 27 show a switch device according to a fourth embodiment of the present invention. As noted above, in the switch device, the single slide plate 401 similar to the slide plate 217 of the third embodiment is used, and a two-way type solenoid device 402 similar to that 55 in the first embodiment is directly coupled to the slide plate 401 through engagement portion 402. The engagement portion 402 projects from the slide plate 401 upwardly in FIG. 25 so as to be engaged with an manipulator end 403 of a knob 404 and downwardly in FIG. 26 to be engaged with a movable member 405 of the solenoid device 402. Accordingly, the slide plate 401 and the movable member 405 are moved in conjunction with the rotational manipulation of the knob 404. Also, as shown in FIG. 27, a moderation or click mechanism 406 is provided in the knob 404 and a housing 405 as in the former embodiments. By the virtue of a spring 407, the knob 404, the slide plate 401 and the movable member 405 are held in a neutral position. When the knob 404 is rotated to move the slide plate 401 and to thereby move the movable member 405 more than the predetermined amound, the movable member is attracted onto an attraction portion 407 and held in that position as in the first embodiment so that the slide plate 401 continues to depress the actuator.

According to the present invention, an amount of depression for each actuator is simply set by the cam configuration of the corresponding cam member and not dependent on the movement of the slide plate, so that the depression amount for the actuator can be made constant regardless of the change in the movement of the slide plate. Accordingly, even if the slide plate is moved with non-uniform amounts in operation, the contact portion of the microswitch mechanism can be surely and appropriately shifted into the desired condition.

Further, according to the present invention, a switch device which has three shift positions, i.e. a neutral position putting a mechanism into OFF-state, a moving-up position putting the mechanism into a state where a window glass of the power window, for example, is moved upward, and a moving-down position putting the mechanism into a state where the window glass is moved downward, and which also has two operation mode positions, i.e. a self-return position and a self-holding position in each of the moving-up and moving-down positions, can be provided with simple construction, and high producibility, stability of performance, reliability of operation, and durability without the requirement that each of component parts must have the extremely high-dimensional precision and the component parts must be assembled with each other in extremely high accuracy.

Furthermore, since the microswitch mechanism is utilized for shifting the electrical contact portions, the contact portions are sealed within the microswitch casing so that the entire switch device is not likely to be adversely effected by the ambient conditions such as dust, ambient humidity, or the like.

Still further, according to the second and third embodiments of the present invention, since a lock plate is utilized for obtaining the self-holding position in each of the moving-up position and the moving-down position, it is possible, in order to retain the locking plate in place, to use a switch shifted position holding solenoid device of a one-way type where a movable member is selectively positioned at only two positions, i.e. a forward position and a rearward position with its maximum stroke. Therefore, the solenoid device can be made simple in construction in comparison with a solenoid device of a two-way type where a movable member is operatively positioned at three positions, and the locking plate can be surely retained in place, thereby securing the self-holding operation.

Other designs within the spirit and scope of the invention will be apparent to those skilled in the field after receiving the above teachings. The invention, therefore, is defined with reference to the following claims.

What is claimed is:

1. A switch device comprising:

a switch casing accommodating therein switch mechanisms having respective first and second actuators juxtaposed with each other, each of said actuators projected from an outer surface of said casing, wherein when one of said actuators is depressed, a corresponding switch mechanism contact portion is independently switched;

a first slide plate slidably provided on said outer surface of said switch casing and having a cam portion which depresses said first actuator by a predetermined constant amount when said first slide plate is move in a first direction from its neutral position, said first slide plate being prevented by a stopper from being slid from its neutral position in a second direction opposite to said first direction;

a second slide plate slidably provided on said outer surface of said switch casing and having a cam portion which depresses said second actuator by said predetermined constant amount when said second slide plate is slid in said second direction from its neutral position, said second slide plate being prevented by a stopper from being moved from its neutral position in said first direction;

a spring means interposed between said first and second slide plates for forcing said first slide plate in said second direction and said second slide plate in said first direction;

a knob having an engagement portion which is engaged between a first engagement projection formed on said first slide plate and a second engagement projection formed on said second slide plate and reciprocally movable in said first and second directions; and a switch shifted position holding solenoid means including, a movable member movable on a guide means in said first and second directions and engaged between said first engagement projection of said first slide plate and said second engagement projection of said second slide plate so that movements in said first and second directions of said movable member are restricted thereby; and an electromagnetic attraction means for applying a first attraction force to said movable member to move said movable member in said first direction by depressing said first actuator and for applying a second attraction force to said movable member to move said movable member in said second direction by depressing said second actuator, so that when said movable member is moved more than a predetermined amount in said first or second direction, said movable member is held at its position.

2. A switch device comprising:

a switch casing accommodating therein switch mechanisms having respective first and second actuators juxtaposed with each other, each of said actuators projected from an outer surface of said casing, wherein when one of said actuators is depressed, a corresponding switch mechanism contact portion is independently switched;

a first slide plate slidably provided on said outer surface of said switch casing and having a cam portion which depresses said first actuator by a predetermined constant amount when said first slide plate is moved in a first direction from its neutral position, said first slide plate being prevented by a stopper from being slid from its neutral position in a second direction opposite to said first direction;

a second slide plate slidably provided on said outer surface of said switch casing and having a cam portion which depresses said second actuator by said predetermined constant amount when said second slide plate is slid in said second direction from its neutral position, said second slide plate being prevented by a stopper from being moved from its neutral position in said first direction;

a knob having an engagement portion which is engaged between a first engagement projection formed on said first slide plate and a second engagement projection formed on said second slide plate and reciprocally movable in said first and second directions;

a lock plate movable in said first and second directions from its neutral position and having a projection extending in a direction generally perpendicular to said first and second directions, said projection being engaged with said first slide plate to be moved in said first direction from its neutral position together with said first slide plate when said first slide plate is moved in said first direction more than a first predetermined amount, and engaged with said second slide plate to be moved in said second direction from its neutral position together with said second slide plate when said second slide plate is moved in said second direction more than a second predetermined amount;

spring means between said casing and said first and second slide plates for biasing said first slide plate in said second direction and said second slide plate in said first direction; and a switch shifted position holding solenoid means including a movable member movable in directions perpendicular to said first and second directions, and positioned at a first position away from said lock plate in a first state and at a second position toward said lock plate in a second state, wherein when said lock plate is moved in said first or second direction from its neutral position, the movable member at said second position is engaged with said projection from said lock plate to retain said lock plate in its position.

3. A switch device comprising:

a switch casing accommodating therein switch mechanisms having respective first and second actuators juxtaposed with each other, each of said actuators projected from an outer surface of said casing, wherein when one of said actuators is depressed, a corresponding switch mechanism contact portion is independently switched;

a slide plate slidably provided on said outer surface of said switch casing, and having a first cam portion which depresses said first actuator by a predetermined constant amount when said slide plate is moved in a first direction from its neutral position and a second cam portion which depresses said second actuator by said predetermined constant amount when said slide plate is slid in said second direction from its neutral position;

a knob engaged with said slide plate to drive said slide plate in said first and second directions;

a lock plate movable in said first and second directions from its neutral position, and having a projection extending in a direction generally perpendicular to said first and second directions, said lock plate being engaged with said slide plate to be moved in said first direction from its neutral position together with said slide plate when said slide plate is moved in said first direction more than a first predetermined amount, and engaged with said slide plate to be moved in said second direction from its neutral position together with said slide plate when said slide plate is moved in said second direction more that a second predetermined amount, said lock plate having a third cam portion which depresses said first actuator by said predetermined constant amount when said lock plate is moved in said first direction from its neutral position and a fourth cam portion which depresses said second actuator by said predetermined constant amount when said lock plate is moved in said second direction from its neutral position;

spring means between said casing and said first and second slide plates for biasing said lock plate toward its neutral position; and a switch shifted position holding solenoid means including a movable member, movable in directions perpendicular to said first and second directions, and positioned at a first position away from said lock plate in a first state and at a second position towards said lock plate in an a second, so that when said lock plate is moved in said first or second direction from its neutral position, said movable member at said second position is engaged with said projection from said lock plate to thereby retain said lock plate in its position.

4. A switch device comprising:

a switch casing accommodating therein switch mechanisms having respective first and second actuators juxtaposed with each other, each of said actuators projected from an outer surface of said casing wherein when one of said actuators is depressed, a corresponding switch mechanism contact portion is independently switched;

a slide plate slidably provided on said outer surface of said switch casing, and having a first cam portion which depresses said first actuator by a predetermined constant amount when said slide plate is moved in a first direction from its neutral position and a second cam portion which depresses said second actuator by said predetermined constant amount when said slide plate is slid in said second direction from its neutral position;

a knob having an engagement portion which is engaged with an engagement projection formed on said slide plate and reciprocally movable in said first and second directions; and a switch shifted position holding solenoid means including, a movable member movable in said first and second directions and engaged with said engagement projection so that movements in said first and second directions of said movable member are restricted thereby; and an electromagnetic attraction means for applying a first attraction force to said movable member to move said movable member in said first direction by depressing said first actuator and for applying a second attraction force to said movable member to move said movable member in said second direction by depressing said second actuator, so that when said movable member is moved more than a predetermined amount in said first or second direction, said movable member is held at its position.

5. A method of switching a mechanism, the method comprising the steps of:

rotating a knob from a starting position;

moving a knob end engaged with said knob in a given direction in response to said rotation;

moving a sliding plate engaged with said knob end from a neutral position in said given direction in response to said knob end motion;

depressing an actuator by a first predetermined amount with a cam portion of said sliding plate as said sliding plate is moved in said given direction;

switching said mechanism into an ON-state in response to said depression of said actuator by said cam; and upon ceasing rotation of said knob, returning said knob to said starting position and said slide plate to said neutral position if said slide plate has been moved less than a second predetermined amount and, if said slide plate has been moved more than said second predetermined amount, returning said knob to said starting position and maintaining said slide plate in a position where said actuator is depressed.

6. A method of switching a mechanism as recited in claim 5, further comprising:

a) biasing said slide plate toward said neutral position with a spring engaging said slide plate; and b) when said knob is rotated further than a third predetermined amount moving a movable member, engaged with an engagement projection on said slide plate, toward an attraction means in said given direction, a force between said movable member and said attraction means exceeding a force of said spring biasing said slide plate toward said neutral position.

7. A method of switching a mechanism, the method comprising the steps of:

rotating a knob from a starting position;

moving a knob end engaged with said knob from a neutral position in a given direction in response to said rotation;

moving a sliding plate engaged with said knob end in said given direction in response to said knob end motion;

depressing an actuator by a first predetermined amount with a cam portion of said sliding plate as said sliding plate is moved in said given direction;

switching said mechanism into an ON-state in response to said depression of said actuator by said cam;

wherein when said knob is rotated further than a second predetermined amount, the steps further comprise:

abutting an engagement projection on said slide plate with a lock plate, as said slide plate is moved;

moving said lock plate in said given direction in response to said abutment with said engagement projection; and when said knob is released from rotation, returning said slide plate to said neutral position, and maintaining said lock plate in a position such that said actuator remains depressed by said first predetermined amount due to said lock plate.

8. A method of switching a mechanism, the method comprising the steps of:

rotating a knob from a starting position;

moving a knob end engaged with said knob in a given direction in response to said rotation;

moving one of a first sliding plate and a second sliding plate in said given direction, against a biasing force of a spring urging said one toward a neutral position, in response to said knob end motion;

depressing an actuator by a first predetermined amount with a portion of said sliding plate as said sliding plate is moved in said given direction; and switching said mechanism into an ON-state in response to said depressing of said actuator.

9. A method of switching a mechanism as recited in claim 8, wherein when said knob is rotated further than a second predetermined amount, the steps further comprise:

moving a movable member, engaged between a first engagement projection on said first slide plate and a second engagement projection on said second slide plate, toward an attraction means in said given direction, a force between said movable member and said attraction means exceeding a force exerted by said spring to bias said one toward said neutral position.

10. A method of switching a mechanism as recited in claim 8, wherein when said knob is rotated further than a second predetermined amount, the steps further comprise:

abutting one of a first engagement projection on said first slide plate and a second engagement projection on said second slide plate with a lock plate, as said slide plate is moved;

moving said lock plate in said given direction in response to said abutment with one of said engagement projections; and when said knob is released from rotation, returning said slide plate to said neutral position, and maintaining said lock plate in a position such that said actuator remains depressed by said first predetermined amount due to said lock plate.

* * * * *